US009848274B2

(12) United States Patent
Pallone et al.

(10) Patent No.: US 9,848,274 B2
(45) Date of Patent: Dec. 19, 2017

(54) SOUND SPATIALIZATION WITH ROOM EFFECT

(71) Applicant: ORANGE, Paris (FR)

(72) Inventors: Gregory Pallone, Betton (FR); Marc Emerit, Rennes (FR)

(73) Assignee: Orange, Paris (FR)

( * ) Notice: Subject to any disclaimer, the term of this patent is extended or adjusted under 35 U.S.C. 154(b) by 0 days.

(21) Appl. No.: 14/906,311

(22) PCT Filed: Jul. 4, 2014

(86) PCT No.: PCT/FR2014/051728
§ 371 (c)(1),
(2) Date: Jan. 20, 2016

(87) PCT Pub. No.: WO2015/011359
PCT Pub. Date: Jan. 29, 2015

(65) Prior Publication Data

US 2016/0174013 A1 Jun. 16, 2016

(30) Foreign Application Priority Data

Jul. 24, 2013 (FR) ..... 13 57299

(51) Int. Cl.
*H04S 7/00* (2006.01)
*G10L 19/008* (2013.01)
*H04S 1/00* (2006.01)

(52) U.S. Cl.
CPC ..... *H04S 7/306* (2013.01); *G10L 19/008* (2013.01); *H04S 1/005* (2013.01); *H04S 7/30* (2013.01);

(Continued)

(58) Field of Classification Search
None
See application file for complete search history.

(56) References Cited

U.S. PATENT DOCUMENTS 7,936,887 B2 5/2011 Smyth
2006/0045294 A1* 3/2006 Smyth ..... H04S 7/304 381/309

FOREIGN PATENT DOCUMENTS

CN 101133679 A 2/2008
WO 2007/031906 A2 3/2007

OTHER PUBLICATIONS

Irwan, Roy, and Ronald M. Aarts. "Two-to-five channel sound processing." Journal of the Audio Engineering Society 50.11 (2002): 914-926.*

(Continued)

*Primary Examiner* — Curtis Kuntz
*Assistant Examiner* — Kenny Truong
(74) *Attorney, Agent, or Firm* — Drinker Biddle & Reath LLP

(57) ABSTRACT

A method of sound spatialization, in which at least one filtering process, including summation, is applied, to at least two input signals, the filtering process comprising: the application of at least one first room effect transfer function, the first transfer function being specific to each input signal, and the application of at least one second room effect transfer function, the second transfer function being common to all input signals. The method is such that it comprises a step of weighting at least one input signal with a weighting factor, said weighting factor being specific to each of the input signals.

14 Claims, 5 Drawing Sheets

Figure 3:
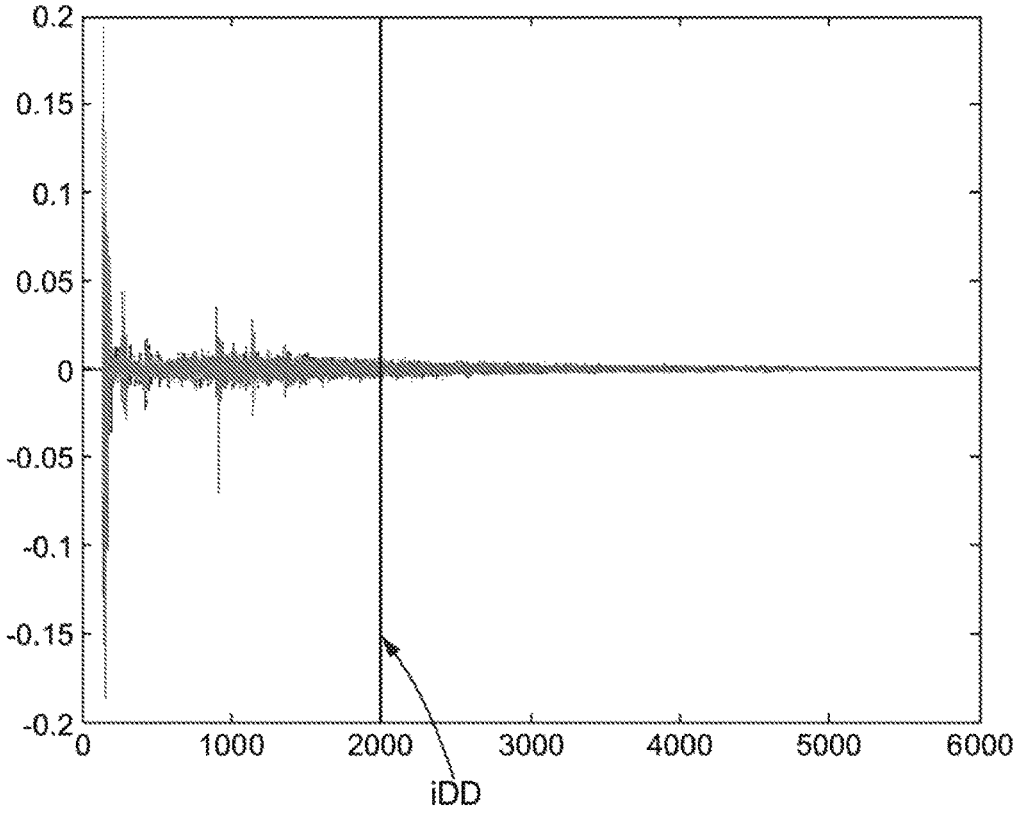

(52) U.S. Cl.
CPC ..... *H04S 2400/03* (2013.01); *H04S 2400/13* (2013.01); *H04S 2420/01* (2013.01)

(56) References Cited

OTHER PUBLICATIONS

Breebaart et al., "Multi-channel goes mobile: MPEG surround binaural rendering," AES 29th International Conference, Audio for Mobile and Handheld Devices, Seoul, KR, Sep. 2, 2006, pp. 1-13.
Jot, "Reat-time spatial processing of sounds for music, multimedia and interactive human-computer interfaces," Multimedia Systems, vol. 7(1), Springer-Verlag, Jan. 1, 1999, pp. 55-69.
Merimaa et al., "Spatial Impulse Response Rendering I: Analysis and Synthesis," Journal of the Audio Engineering Society, Audio Engineering Society, New York, NY, US, vol. 53 (12), Dec. 1, 2005, pp. 1115-1127.
Savioja et al., "Creating Interactive Virtual Acoustic Environments," Journal of the Audio Engineering Society, Audio Engineering Society, New York, NY, US, vol. 47(9), Sep. 1, 1999, pp. 675-705.
Stewart et al., "Generating a Spatial Average Reverberation Tail Across Multiple Impulse Responses," AES 35th International Conference: Audio for Games, London, UK, Audio Engineering Society, New York, NY, US, Feb. 1, 2009, pp. 1-6.
Office Action issued in corresponding application CN 201480052602.X, Jan. 4, 2017, with English language translation, 14 pages.

* cited by examiner

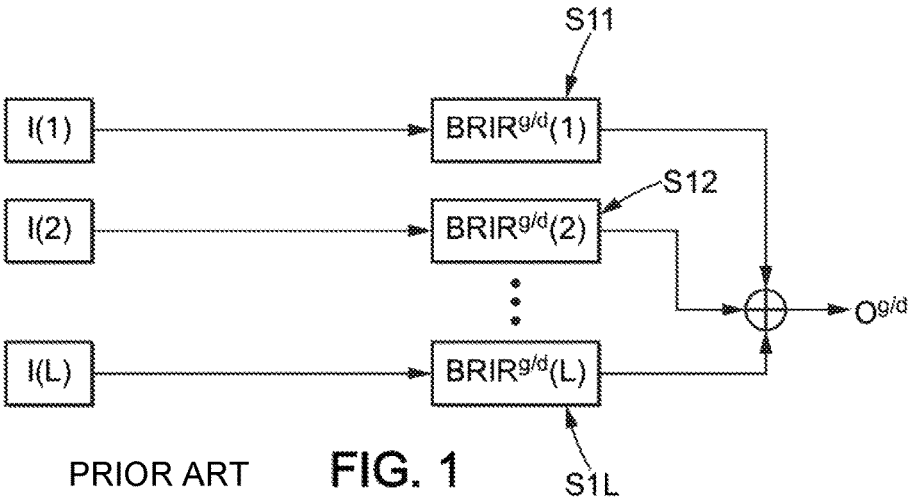
PRIOR ART FIG. 1
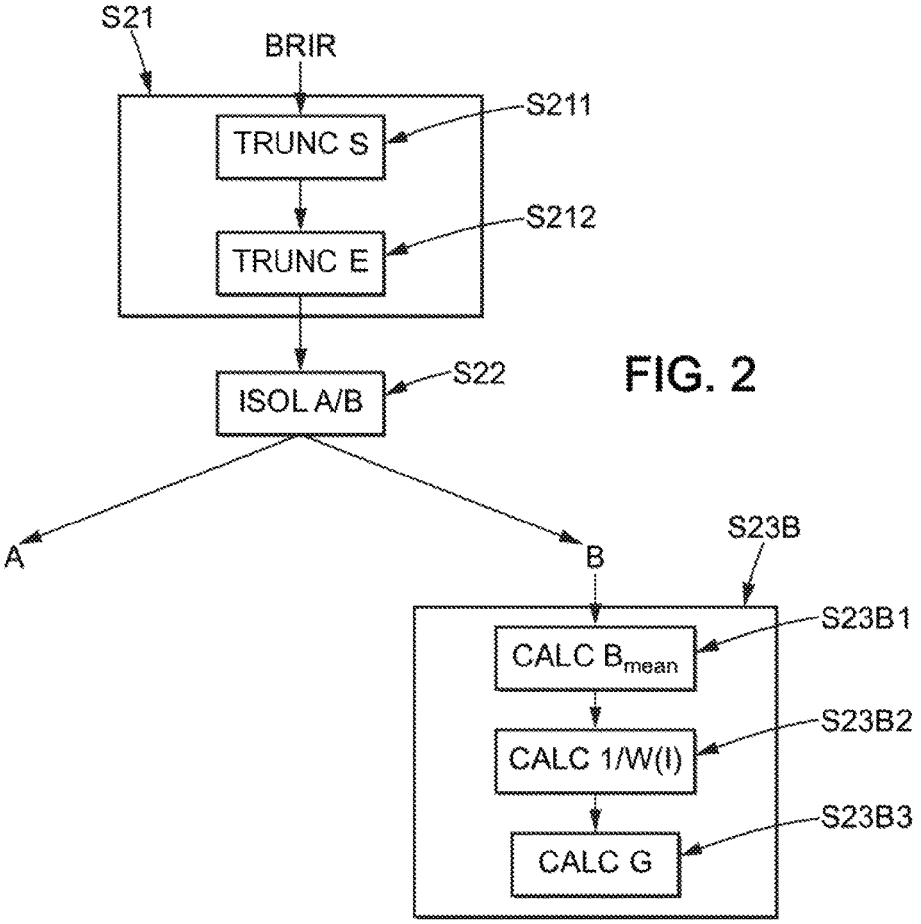
FIG. 2

SOUND SPATIALIZATION WITH ROOM EFFECT

The invention relates to the processing of sound data, and more particularly to the spatialization (referred to as "3D rendering") of audio signals.

Such an operation is performed, for example, when decoding an encoded 3D audio signal represented on a certain number of channels, to a different number of channels, for example two, to enable rendering 3D audio effects in an audio headset.

The invention also relates to the transmission and rendering of multichannel audio signals and to their conversion for a transducer rendering device imposed by the user's equipment. This is the case, for example, when rendering a scene with 5.1 sound on an audio headset or a pair of speakers.

The invention also relates to the rendering, in a video game or recording for example, of one or more sound samples stored in files, for spatialization purposes.

In the case of a static monophonic source, binauralization is based on filtering the monophonic signal by the transfer function between the desired position of the source and each of the two ears. The obtained binaural signal (two channels) can then be supplied to an audio headset and give the listener the sensation of a source at the simulated position. Thus, the term "binaural" concerns the rendering of an audio signal with spatial effects.

Each of the transfer functions simulating different positions can be measured in an anechoic chamber, yielding a set of HRTF ("Head Related Transfer Functions") in which no room effect is present.

These transfer functions can also be measured in a "standard" room, yielding a set of BRIR ("Binaural Room Impulse Response") in which the room effect, or reverberation, is present. The set of BRIR thus corresponds to a set of transfer functions between a given position and the ears of a listener (actual or dummy head) placed in a room.

The usual technique for measuring BRIR consists of sending successively to each of a set of actual speakers, positioned around a head (real or dummy) having microphones in the ears, a test signal (for example a sweep signal, a pseudorandom binary sequence, or white noise). This test signal makes it possible to reconstruct (generally by deconvolution), in non-real-time, the impulse response between the position of the speaker and each of the two ears.

The difference between a set of HRTF and a set of BRIR lies predominantly in the length of the impulse response, which is about a millisecond for HRTF and about a second for BRIR.

As the filtering is based on the convolution between the monophonic signal and the impulse response, the complexity in performing binauralization with BRIR (containing a room effect) is significantly higher than with HRTF.

It is possible with this technique to simulate, in a headset or with a limited number of speakers, listening to multichannel content (L channels) generated by L speakers in a room. Indeed, it is sufficient to consider each of the L speakers as a virtual source ideally positioned relative to the listener, measure in the room to be simulated the transfer functions (for the left and right ears) of each of these L speakers, and then apply to each of the L audio signals (supposedly fed to L actual speakers) the BRIR filters corresponding to the speakers. The signals supplied to each of the ears are summed to provide a binaural signal supplied to an audio headset.

We denote the input signal to be fed to the L speakers as I(l) (where l=[1, L]). We denote the BRIR of each of the speakers for each of the ears as $BRIR^{g/d}(l)$, and we denote the binaural signal that is output as $O^{g/d}$. Hereinafter, "g" and "d" are understood to indicate "left" and "right" respectively. The binauralization of the multichannel signal is thus written:

$$O^g = \sum_{l=1}^{L} I(l) * BRIR^g(l)$$

$$O^d = \sum_{l=1}^{L} I(l) * BRIR^d(l)$$

where * represents the convolution operator.

Below, the index l such that l∈[1, L] refers to one of the L speakers. We have one BRIR for one signal l.

Thus, referring to FIG. 1, two convolutions (one for each ear) are present for each speaker (steps S11 to S1L).

For L speakers, the binauralization therefore requires 2·L convolutions. We can calculate the complexity $C_{conv}$ for the case of a fast block-based implementation. A fast block-based implementation is for example given by a fast Fourier transform (FFT). The document "Submission and Evaluation Procedures for 3D Audio" (MPEG 3D Audio) specifies a possible formula for calculating $C_{conv}$:

$$C_{conv}=(L+2)\cdot(n\text{Blocks})\cdot(6\cdot\log_2(2Fs/n\text{Blocks}))$$

In this equation, L represents the number of FFTs to transform the frequency of the input signals (one FFT per input signal), the 2 represents the number of inverse FFTs to obtain the temporal binaural signal (2 inverse FFTs for the two binaural channels), the 6 indicates a complexity factor per FFT, the second 2 indicates a padding of zeros necessary to avoid problems due to circular convolution, Fs indicates the size of each BRIR, and nBlocks represents the fact that block-based processing is used, more realistic in an approach where latency must not be excessively high, and · represents multiplication.

Thus, for a typical use with nBlocks=10, Fs=48000, L=22, the complexity per multichannel signal sample for a direct convolution based on an FFT is $C_{conv}$=19049 multiplications-additions.

This complexity is too high for a realistic implementation on the current processors of today (mobile phones for example), so it is necessary to reduce this complexity without significantly degrading the binauralization rendered.

For the spatialization to be of good quality, the entire temporal signal of the BRIRs must be applied.

The present invention improves the situation.

It aims to significantly reduce the complexity of binauralization of a multichannel signal with room effect, while maintaining the best possible audio quality.

For this purpose, the invention relates to a method of sound spatialization, wherein at least one filtering process, including summation, is applied to at least two input signals (I(1), I(2), I(L)), said filtering process comprising:

the application of at least one first room effect transfer function ($A^k$(1), $A^k$(2), . . . , $A^k$(L)), this first transfer function being specific to each input signal, and the application of at least one second room effect transfer function ($B_{mean}{}^k$), said second transfer function being common to all input signals. The method is such that it comprises a step of weighting at least one input signal with a weighting factor ($W^k$(l)), said weighting factor being specific to each of the input signals.

The input signals correspond, for example, to different channels of a multichannel signal. Such filtering can in particular provide at least two output signals intended for spatialized rendering (binaural or transaural, or with rendering of surround sound involving more than two output signals). In one particular embodiment, the filtering process delivers exactly two output signals, the first output signal being spatialized for the left ear and the second output signal being spatialized for the right ear. This makes it possible to preserve a natural degree of correlation that may exist between the left and right ears at low frequencies.

The physical properties (for example the energy or the correlation between different transfer functions) of the transfer functions over certain time intervals make simplifications possible. Over these intervals, the transfer functions can thus be approximated by a mean filter.

The application of room effect transfer functions is therefore advantageously compartmentalized over these intervals. At least one first transfer function specific to each input signal can be applied for intervals where it is not possible to make approximations. At least one second transfer function approximated in a mean filter can be applied for intervals where it is possible to make approximations.

The application of a single transfer function common to each of the input signals substantially reduces the number of calculations to be performed for spatialization. The complexity of this spatialization is thus advantageously reduced. This simplification thus advantageously reduces the processing time while decreasing the load on the processor(s) used for these calculations.

In addition, with weighting factors specific to each of the input signals, the energy differences between the various input signals can be taken into account even if the processing applied to them is partially approximated by a mean filter.

In one particular embodiment, the first and second transfer functions are respectively representative of:

- direct sound propagations and the first sound reflections of these propagations; and
- a diffuse sound field present after these first reflections, and the method of the invention further comprises:

- the application of first transfer functions respectively specific to the input signals, and
- the application of a second transfer function, identical for all input signals, and resulting from a general approximation of a diffuse sound field effect.

Thus, the processing complexity is advantageously reduced by this approximation. In addition, the influence of such an approximation on the processing quality is reduced because this approximation is related to diffuse sound field effects and not to direct sound propagations. These diffuse sound field effects are less sensitive to approximations. The first sound reflections are typically a first succession of echoes of the sound wave. In one practical exemplary embodiment, it is assumed that there are at most two of these first reflections.

In another embodiment, a preliminary step of constructing first and second transfer functions from impulse responses incorporating a room effect, comprises, for the construction of a first transfer function, the operations of:

- determining a start time of the presence of direct sound waves,
- determining a start time of the presence of the diffuse sound field after the first reflections, and
- selecting, in an impulse response, a portion of the response which extends temporally between the start time of the presence of direct sound waves to the start time of the presence of the diffuse field, the selected portion of the response corresponding to the first transfer function.

In one particular embodiment, the start time of the presence of the diffuse field is determined based on predetermined criteria. In one possible embodiment, the detection of a monotonic decrease of a spectral density of the acoustic power in a given room can typically characterize the start of the presence of the diffuse field, and from there, provide the start time of the presence of the diffuse field.

Alternatively, the start time of its presence can be determined by an estimate based on room characteristics, for example simply from the volume of the room as will be seen below.

Alternatively, in a simpler embodiment, one can consider that if an impulse response extends over N samples, then the start time of the presence of the diffuse field occurs for example after N/2 samples of the impulse response. Thus, the start time of its presence is predetermined and corresponds to a fixed value. Typically, this value can be for example the $2048^{th}$ sample among 48000 samples of an impulse response incorporating a room effect.

The start time of the presence of the abovementioned direct sound waves may correspond, for example, to the start of the temporal signal of an impulse response with room effect.

In a complementary embodiment, the second transfer function is constructed from a set of portions of impulse responses temporally starting after the start time of the presence of the diffuse field.

In a variant, the second transfer function can be determined from the characteristics of the room, or from predetermined standard filters.

Thus, the impulse responses incorporating a room effect are advantageously partitioned into two parts separated by a presence start time. Such a separation makes it possible to have processing adapted to each of these parts. For example, one can take a selection of the first samples (the first 2048) of an impulse response for use as a first transfer function in the filtering process, and ignore the remaining samples (from 2048 to 48000, for example) or average them with those from other impulse responses.

The advantage of such an embodiment is then, in a particularly advantageous manner, that it simplifies the filtering calculations specific to the input signals, and adds a form of noise originating from the sound diffusion which can be calculated using the second halves of the impulse responses (as an average for example as discussed below), or simply from a predetermined impulse response estimated only on the basis of characteristics of a certain room (volume, coverings on the walls of the room, etc.) or of a standard room.

In another variant, the second transfer function is given by applying a formula of the type:

$$B^k_{mean} = \frac{1}{L}\sum_{l=1}^{L} [B^k_{norm}(l)]$$

where k is the index of an output signal, $l \in [1; L]$ is the index of an input signal, L is the number of input signals, $B_{norm}{}^k(l)$ is a normalized transfer function obtained from a set of portions of impulse responses starting temporally after the start time of the presence of the diffuse field.

In one embodiment, the first and second transfer functions are obtained from a plurality of binaural room impulse responses BRIR.

In another embodiment, these first and second transfer functions are obtained from experimental values resulting from measuring propagations and reverberations in a given room. The processing is thus carried out on the basis of experimental data. Such data very accurately reflect the room effects and therefore guarantee a highly realistic rendering.

In another embodiment, the first and second transfer functions are obtained from reference filters, for example synthesized with a feedback delay network.

In one embodiment, a truncation is applied to the start of the BRIRs. Thus, the first BRIR samples for which the application to the input signals has no influence are advantageously removed.

In another particular embodiment, a truncation compensating delay is applied at the start of the BRIR. This compensating delay compensates for the time lag introduced by truncation.

In another embodiment, a truncation is applied at the end of the BRIR. The last BRIR samples for which the application to the input signals has no influence are thus advantageously removed.

In one embodiment, the filtering process includes the application of at least one compensating delay corresponding to a time difference between the start time of the direct sound waves and the start time of the presence of the diffuse field. This advantageously compensates for delays that may be introduced by the application of time-shifted transfer functions.

In another embodiment, the first and second room effect transfer functions are applied in parallel to the input signals. In addition, at least one compensating delay is applied to the input signals filtered by the second transfer functions. Thus, simultaneous processing of these two transfer functions is possible for each of the input signals. Such processing advantageously reduces the processing time for implementing the invention.

In one particular embodiment, an energy correction gain factor is applied to the weighting factor.

Thus at least one energy correction gain factor is applied to at least one input signal. The delivered amplitude is thus advantageously normalized. This energy correction gain factor allows consistency with the energy of binauralized signals.

It allows correcting the energy of binauralized signals according to the degree of correlation of the input signals.

In one particular embodiment, the energy correction gain factor is a function of the correlation between input signals. The correlation between signals is thus advantageously taken into account.

In one embodiment, at least one output signal is given by applying a formula of the type:

$$O^k = \sum_{l=1}^{L} (I(l) * A^k(l)) + z^{-iDD} \cdot \sum_{l=1}^{L} \left( \frac{1}{W^k(l)} \cdot I(l) \right) * B^k_{mean}$$

where k is the index of an output signal, $O^k$ is an output signal, $l \in [1; L]$ is the index of an input signal among the input signals, L is the number of input signals, I(l) is an input signal among the input signals, $A^k(l)$ is a room effect transfer function among the first room effect transfer functions, $B_{mean}{}^k$ is a room effect transfer function among the second room effect transfer functions, $W^k(l)$ is a weighting factor among the weighting factors, $z^{-iDD}$ corresponds to the application of the compensating delay, with · indicating multiplication, and

* being the convolution operator.

In another embodiment, a decorrelation step is applied to the input signals prior to applying the second transfer functions. In this embodiment, at least one output signal is therefore obtained by applying a formula of the type:

$$O^k = \sum_{l=1}^{L} (I(l) * A^k(l)) + z^{-iDD} \cdot \sum_{l=1}^{L} \left( \frac{1}{W^k(l)} \cdot I_d(l) \right) * B^k_{mean}$$

where $I_d(l)$ is a decorrelated input signal among said input signals, the other values being those defined above. Energy imbalances due to energy differences between the additions of correlated signals and the additions of decorrelated signals can thus be taken into account.

In one particular embodiment, the decorrelation is applied prior to filtering. Energy compensation steps can thus be eliminated during filtration.

In one embodiment, at least one output signal is obtained by applying a formula of the type:

$$O^k = \sum_{l=1}^{L} (I(l) * A^k(l)) + z^{-iDD} \cdot \sum_{l=1}^{L} \left( G(I(l)) \cdot \frac{1}{W^k(l)} \cdot I(l) \right) * B^k_{mean}$$

where G(I(l)) is the determined energy correction gain factor, the other values being those defined above. Alternatively, G does not depend on I(l).

In one embodiment, the weighting factor is given by applying a formula of the type:

$$W^k(l) = \frac{\sqrt{E_{B^k_{mean}}}}{\sqrt{E_{B^k(l)}}}$$

where k is the index of an output signal, $l \in [1; L]$ is the index of an input signal among the input signals, L is the number of input signals, where $E_{B_{mean}{}^k}$ is the energy of a room effect transfer function among the second room effect mean transfer functions, $E_{B^k(l)}$ is energy relating to normalization gain.

The invention also relates to a computer program comprising instructions for implementing the method described above.

The invention may be implemented by a sound spatialization device, comprising at least one filter with summation applied to at least two input signals (I(1), I(2), . . . , I(L)), said filter using:

at least one first room effect transfer function ($A^k$(1), $A^k$(2), . . . , $A^k$(L)), said first transfer function being specific to each input signal, and at least one second room effect transfer function ($B_{mean}^{k}$), said second transfer function being common to all input signals.

The device is such that it comprises weighting modules for weighting at least one input signal with a weighting factor, said weighting factors being specific to each of the input signals.

Such a device may be in the form of hardware, for example a processor and possibly working memory, typically in a communications terminal.

The invention may also be implemented as input signals in an audio signal decoding module comprising the spatialization device described above.

Figure 4:
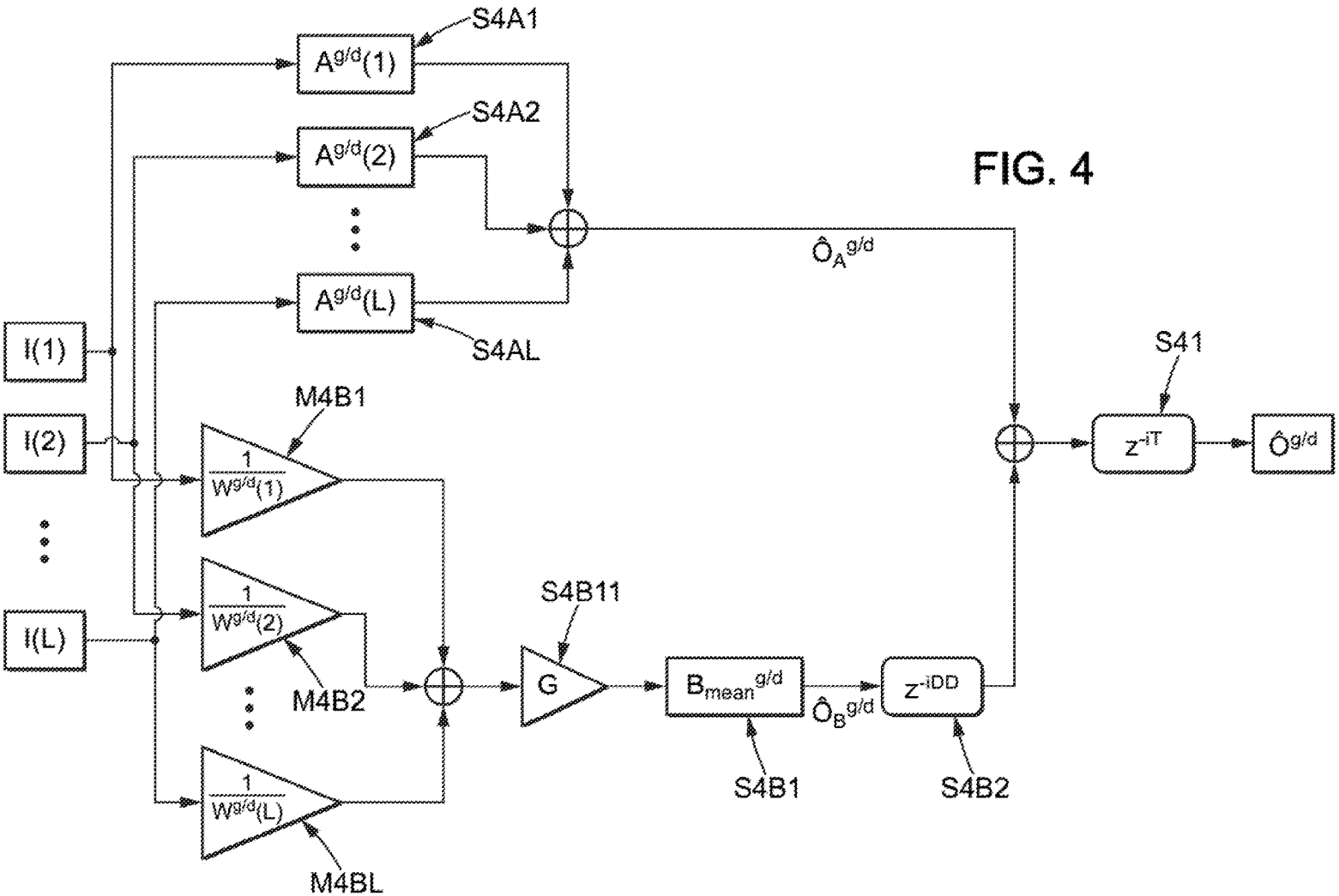
Figure 5:
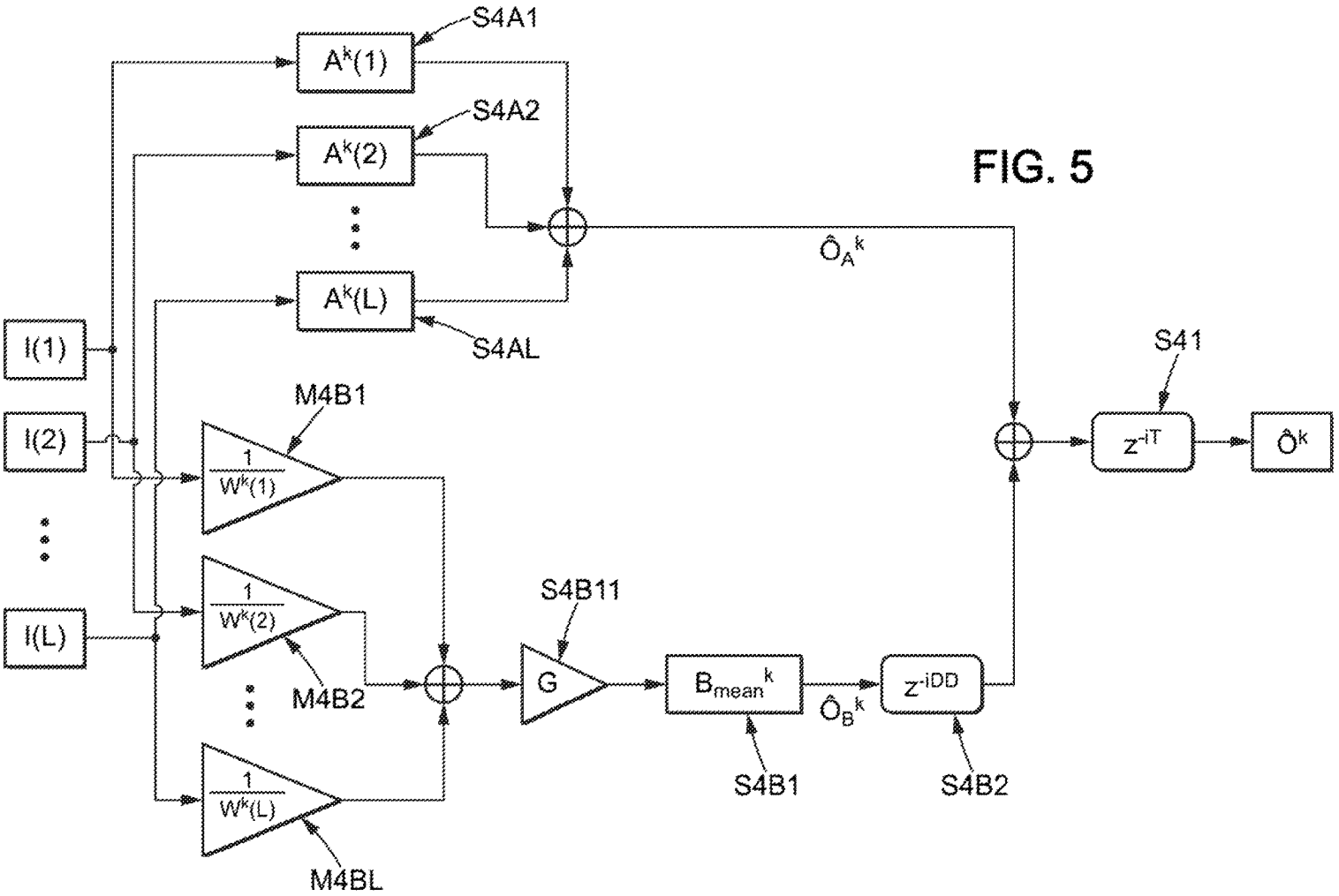
Figure 6:
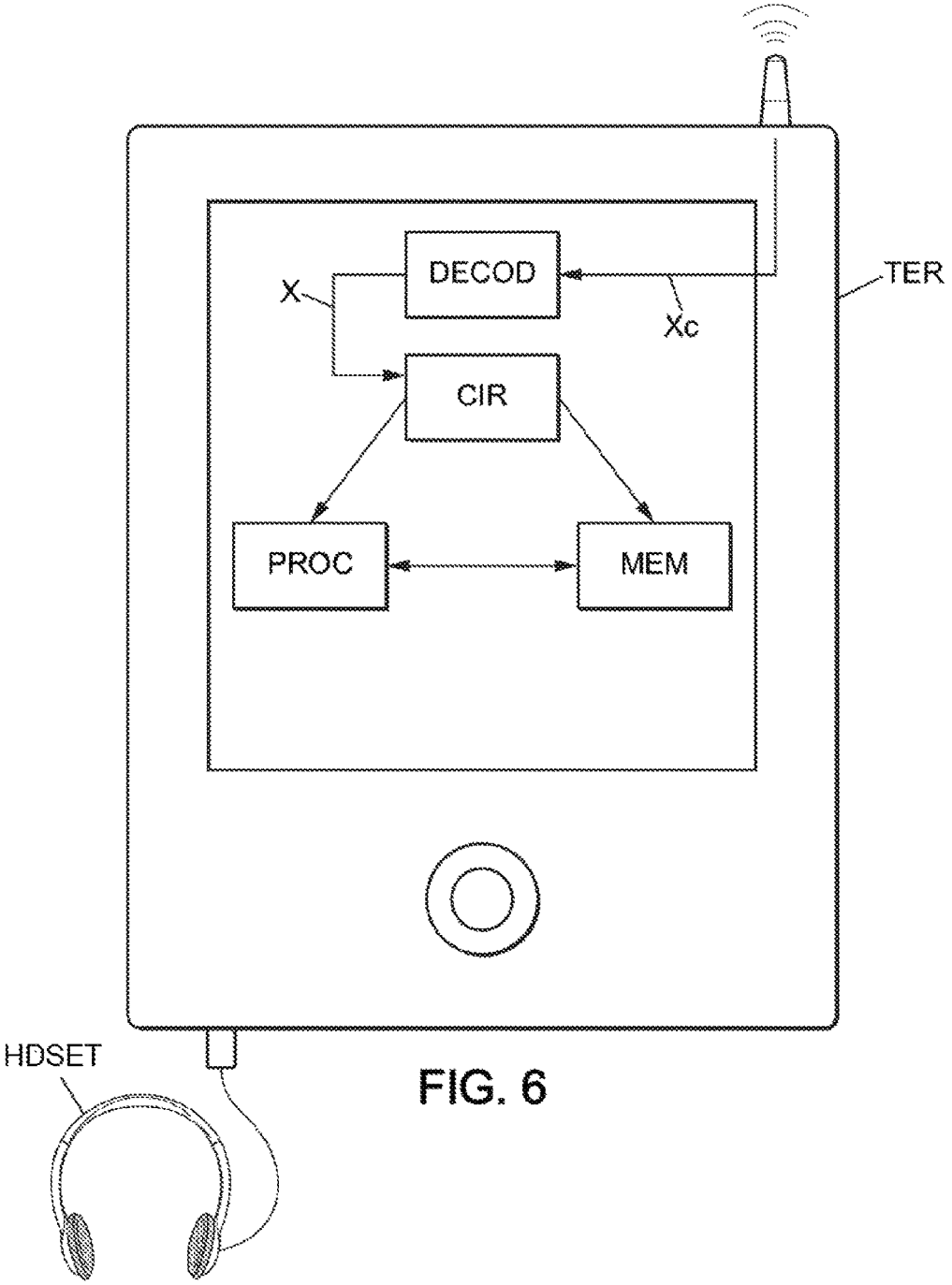

Other features and advantages of the invention will be apparent from reading the following detailed description of embodiments of the invention and from reviewing the drawings in which:

FIG. 1 illustrates a spatialization method of the prior art,

FIG. 2 schematically illustrates the steps of a method according to the invention, in one embodiment, FIG. 3 represents a binaural room impulse response BRIR, FIG. 4 schematically illustrates the steps of a method according to the invention, in one embodiment, FIG. 5 schematically illustrates the steps of a method according to the invention, in one embodiment, FIG. 6 schematically represents a device having means for implementing the method according to the invention.

FIG. 6 illustrates a possible context for implementing the invention in a device that is a connected terminal TER (for example a telephone, smartphone, or the like, or a connected tablet, connected computer, or the like). Such a device TER comprises receiving means (typically an antenna) for receiving compressed encoded audio signals Xc, a decoding device DECOD delivering decoded signals X ready for processing by a spatialization device before rendering the audio signals (for example binaurally in a headset with earbuds HDSET). Of course, in some cases it may be advantageous to keep the partially decoded signals (for example in the subband domain) if the spatialization processing is performed in the same domain (frequency processing in the subband domain for example).

Still referring to FIG. 6, the spatialization device is presented as a combination of elements:

hardware, typically including one or more circuits CIR cooperating with a working memory MEM and a processor PROC, and software, for which FIGS. 2 and 4 show example flowcharts illustrating the general algorithm.

Here, the cooperation between hardware and software elements produces a technical effect resulting in savings in the complexity of the spatialization, for substantially the same audio rendering (same sensation for a listener), as discussed below.

We now refer to FIG. 2 to describe a processing in the sense of the invention, as implemented by computing means.

In a first step S21, the data are prepared. This preparation is optional; the signals may be processed in step S22 and subsequent steps without this pre-processing.

In particular, this preparation consists of truncating each BRIR to ignore the inaudible samples at the beginning and end of the impulse response.

For the truncation at the start of the impulse response TRUNC S, in step S211, this preparation consists of determining a direct sound waves start time and may be implemented by the following steps:

A cumulative sum of the energies of each of the BRIR filters (1) is calculated. Typically, this energy is calculated by summing the square of the amplitudes of samples 1 to j, with j in [1; J] and J being the number of samples of a BRIR filter.

The energy value of the maximum energy filter valMax (among the filters for the left ear and for the right ear) is calculated.

For each of the speakers 1, we calculate the index for which the energy of each of the BRIR filters (1) exceeds a certain dB threshold calculated relative to valMax (for example valMax−50 dB).

The truncation index iT retained for all BRIR is the minimum index among all BRIR indices and is considered as the direct sound waves start time.

The resulting index iT therefore corresponds to the number of samples to be ignored for each BRIR. A sharp truncation at the start of the impulse response using a rectangular window can lead to audible artifacts if applied to a higher energy segment. It may therefore be preferable to apply an appropriate fade-in window; however, if precautions have been taken in the threshold chosen, such windowing becomes unnecessary as it would be inaudible (only the inaudible signal is cut).

The synchrony between BRIR makes it possible to apply a constant delay for all BRIR for the sake of simplicity in implementation, even if it is possible to optimize the complexity.

Truncation of each BRIR to ignore inaudible samples at the end of the impulse response TRUNC E, in step S212, may be performed starting with steps similar to those described above but adapted for the end of the impulse response. A sharp truncation at the end of the impulse response using a rectangular window can lead to audible artifacts on the impulse signals where the tail of the reverberation could be audible. Thus, in one embodiment, a suitable fade-out window is applied.

In step 22, a synchronistic isolation ISOL A/B is performed. This synchronistic isolation consists of separating, for each BRIR, the "direct sound" and "first reflections" portion (Direct, denoted A) and the "diffused sound" portion (Diffuse, denoted B). The processing to be performed on the "diffused sound" portion may advantageously be different from that performed on the "direct sound" portion, to the extent that it is preferable to have a better quality of processing on the "direct sound" portion than on the "diffused sound" portion. This makes it possible to optimize the ratio of quality/complexity.

In particular, to achieve synchronistic isolation, a unique sampling index "iDD" common to all BRIR (hence the term "synchronistic") is determined, starting at which the rest of the impulse response is considered as corresponding to a diffuse field. The impulse responses BRIR(l) are therefore partitioned into two parts: A(l) and B(l), where the concatenation of the two corresponds to BRIR(l).

FIG. 3 shows the partitioning index iDD at the sample 2000. The left portion of this index iDD corresponds to part A. The right portion of this index iDD corresponds to part B. In one embodiment, these two parts are isolated, without windowing, in order to undergo different processing. Alternatively, windowing between parts A(l) and B(l) is applied.

The index iDD may be specific to the room for which the BRIR were determined. Calculation of this index may therefore depend on the spectral envelope, on the correlation of the BRIR, or on the echogram of these BRIR. For example, the iDD can be determined by a formula of the type iDD=$\sqrt{V_{room}}$ where $V_{room}$ is the volume of the room where measured.

In one embodiment, iDD is a fixed value, typically 2000. Alternatively, iDD varies, preferably dynamically, depending on the environment from which the input signals are captured.

The output signal for the left (g) and right (d) ears, represented by $O^{g/d}$, is therefore written:

$$O^{g/d} = \sum_{l=1}^{L} I(l) * BRIR^{g/d}(l) = O_A^{g/d} + z^{-iDD} \cdot O_B^{g/d} = \sum_{l=1}^{L} I(l) * A^{g/d}(l) + z^{-iDD} \cdot \sum_{l=1}^{L} I(l) * B^{g/d}(l)$$

where $z^{-iDD}$ corresponds to the compensating delay for iDD samples.

This delay is applied to the signals by storing the values calculated for $\Sigma_{l=1}^{L} I(l)*B^{g/d}(l)$ in temporary memory (for example a buffer) and retrieving them at the desired moment.

In one embodiment, the sampling indexes selected for A and B may also take into account the frame lengths in the case of integration into an audio encoder. Indeed, typical frame sizes of 1024 samples can lead to choosing A=1024 and B=2048, ensuring that B is indeed a diffuse field area for all the BRIR.

In particular, it may be advantageous that the size of B is a multiple of the size of A, because if the filtering is implemented by FFT blocks, then the calculation of an FFT for A can be reused for B.

A diffuse field is characterized by the fact that it is statistically identical at all points of the room. Thus, its frequency response varies very little for the speaker to be simulated. The invention exploits this feature in order to replace all Diffuse filters D(l) of all the BRIR by a single "mean" filter $B_{mean}$, in order to greatly reduce the complexity due to multiple convolutions. For this, again referring to FIG. 2, one can change the diffuse field part B in step S23B.

In step S23B1, the value of the mean filter $B_{mean}$ is calculated. It is extremely rare that the entire system is calibrated perfectly, so we can apply a weighting factor which will be carried forward in the input signal in order to achieve a single convolution per ear for the diffuse field part. Therefore the BRIR are separated in energy-normalized filters, and the normalization gain $\sqrt{E_{B^{g/d}(l)}}$ is carried forward in the input signal:

$$O_B^{g/d} = \sum_{l=1}^{L} [I(l) * B^{g/d}(l)] = \sum_{l=1}^{L} \left[I(l) * \left(\sqrt{E_{B^{g/d}(l)}} \cdot B_{norm}^{g/d}(l)\right)\right] = \sum_{l=1}^{L} \left[\left(\sqrt{E_{B^{g/d}(l)}} \cdot I(l)\right) * B_{norm}^{g/d}(l)\right]$$

where $B_{norm}^{g/d}(l) = \frac{B^{g/d}(l)}{\sqrt{E_{B^{g/d}}(l)}}$ with $E_{B^{g/d}(l)}$ representing the energy of $B^{g/d}(l)$.

Next, we approximate $B_{norm}^{g/d}(l)$ with a single mean filter $B_{mean}^{g/d}$ which is no longer a function of the speaker 1, but which it is also possible to energy-normalize:

$$O_B^{g/d} \approx \hat{O}_B^{g/d} = \sum_{l=1}^{L} \left[\left(\sqrt{E_{B^{g/d}(l)}} \cdot I(l)\right) * \left(\frac{B_{mean}^{g/d}}{\sqrt{E_{B_{mean}^{g/d}}}}\right)\right] \text{ where } B_{mean}^{g/d} = \frac{1}{L}\sum_{l=1}^{L} [B_{norm}^{g/d}(l)].$$

In one embodiment, this mean filter may be obtained by averaging temporal samples. Alternatively, it may be obtained by any other type of averaging, for example by averaging the power spectral densities.

In one embodiment, the energy of the mean filter $E_{B_{mean}^{g/d}}$ may be measured directly using the constructed filter $E_{B_{mean}^{g/d}}$. In a variant, it may be estimated using the hypothesis that the filters $B_{norm}^{g/d}(l)$ are decorrelated. In this case, because the unitary energy signals are summed, we have:

$$E_{B_{mean}^{g/d}} = \sum \left(\frac{1}{L}\sum_{l=1}^{L} [B_{norm}^{g/d}(l)]\right)^2 = \frac{1}{L^2} \cdot \left(L \cdot E_{B_{norm}^{g/d}}\right) = \frac{1}{L}$$

The energy can be calculated over all samples corresponding to the diffuse field part.

In step S23B2, the value of the weighting factor $W^{g/d}(l)$ is calculated. Only one weighting factor to be applied to the input signal is calculated, incorporating the normalizations of the Diffuse filters and mean filter:

$$\hat{O}_B^{g/d} = \sum_{l=1}^{L} \left[\left(\frac{\sqrt{E_{B^{g/d}(l)}}}{\sqrt{E_{B_{mean}^{g/d}}}} \cdot I(l)\right) * B_{mean}^{g/d}\right] = \sum_{l=1}^{L} \left[\left(\frac{1}{W^{g/d}(l)} \cdot I(l)\right) * B_{mean}^{g/d}\right]$$

with $W^{g/d}(l) = \frac{\sqrt{E_{B_{mean}^{g/d}}}}{\sqrt{E_{B^{g/d}(l)}}}$

As the mean filter is constant, from this sum we have:

$$\hat{O}_B^{g/d} = \sum_{l=1}^{L} \left[\left(\frac{1}{W^{g/d}(l)} \cdot I(l)\right)\right] * B_{mean}^{g/d}$$

Thus, the L convolutions with the diffuse field part are replaced by a single convolution with a mean filter, with a weighted sum of the input signal.

In step S23B3, we can optionally calculate a gain G correcting the gain of the mean filter $B_{mean}^{g/d}$. Indeed, in the case of convolution between the input signals and the non-approximated filters, regardless of the correlation values between the input signals, the filtering by the decorrelated filters which are the $B^{g/d}(l)$ results in signals to be summed which are then also decorrelated. Conversely, in the case of convolution between the input signals and the approximated mean filter, the energy of the signal resulting from summing the filtered signals will depend on the value of the correlation existing between the input signals.

For example,

* if all the input signals I(l) are identical and of unitary energy, and the filters B(l) are all decorrelated (because diffuse fields) and of unitary energy, we have $$E_{O_B^{g/d}} = \text{energy}\left(\sum_{l=1}^{L} [I(l) * B_{norm}^{g/d}(l)]\right) = L$$

* if all the input signals I(l) are decorrelated and of unitary energy, and the filters B(l) are all of unitary energy but are replaced with identical filters $$\frac{B_{mean}^{g/d}}{\sqrt{E_{B_{mean}^{g/d}}}},$$

we have:

$$E_{\hat{O}_B^{g/d}} = \text{energy}\left(\sum_{l=1}^{L}\left[I(l) * \left(\frac{B_{mean}^{g/d}}{\sqrt{E_{B_{mean}^{g/d}}}}\right)\right]\right) =$$

$$\text{energy}\left(\frac{1}{\sqrt{E_{B_{mean}^{g/d}}}} \cdot \sum_{l=1}^{L} [I(l) * B_{mean}^{g/d}]\right) = \left(\frac{1}{\sqrt{E_{B_{mean}^{g/d}}}}\right)^2 \cdot \left(L \cdot \frac{1}{L}\right) = L$$

because the energies of the decorrelated signals are added.

This case is equivalent to the preceding case in the sense that the signals resulting from filtration are all decorrelated, by means of the input signals in the first case, and by means of the filters in the second case.

* if all the input signals I(l) are identical and of unitary energy, and the filters B(l) are all of unitary energy but are replaced with identical filters $$\frac{B_{mean}^{g/d}}{\sqrt{E_{B_{mean}^{g/d}}}},$$

we have:

$$E_{\hat{O}_B^{g/d}} = \text{energy}\left(\sum_{l=1}^{L}\left[I(l) * \left(\frac{B_{mean}^{g/d}}{\sqrt{E_{B_{mean}^{g/d}}}}\right)\right]\right) =$$

$$\text{energy}\left(\frac{1}{\sqrt{E_{B_{mean}^{g/d}}}} \cdot \sum_{l=1}^{L} [I(l) * B_{mean}^{g/d}]\right) = \left(\frac{1}{\sqrt{E_{B_{mean}^{g/d}}}}\right)^2 \cdot \left(L^2 \cdot \frac{1}{L}\right) = L^2$$

because the energies of the identical signals are added in quadrature (because their amplitudes are summed).

So,

If two speakers are active simultaneously, supplied with decorrelated signals, then no gain is obtained by applying steps S23B1 and S23B2 in comparison to the conventional method.

If two speakers are active simultaneously, supplied with identical signals, then a gain of $10 \cdot \log_{10}(L^2/L) = 10 \cdot \log_{10}(2^2/2) = 3.01$ dB is obtained by applying steps S23B1 and S23B2 in comparison to the conventional method.

If three speakers are active simultaneously, supplied with identical signals, then a gain of $10 \cdot \log_{10}(L^2/L) = 10 \cdot \log_{10}(3^2/3) = 4.77$ dB is obtained by applying steps S23B1 and S23B2 in comparison to the conventional method.

The cases mentioned above correspond to the extreme cases of identical or decorrelated signals. These cases are realistic, however: a source positioned in the middle of two speakers, virtual or real, will provide an identical signal to both speakers (for example with a VBAP ("vector-based amplitude panning") technique). In the case of positioning within a 3D system, the three speakers can receive the same signal at the same level.

Thus, we can apply a compensation in order to achieve consistency with the energy of binauralized signals.

Ideally, this compensation gain G is determined according to the input signal (G(I(l))) and will be applied to the sum of the weighted input signals:

$$\hat{O}_B^{g/d} = G \cdot \sum_{l=1}^{L}\left[\frac{1}{W^{g/d}(l)} \cdot I(l)\right] * B_{mean}^{g/d}$$

The gain G (I(l)) may be estimated by calculating the correlation between each of the signals. It may also be estimated by comparing the energies of the signals before and after summation. In this case, the gain G can dynamically vary over time, depending for example on the correlations between the input signals, which themselves vary over time.

In a simplified embodiment, it is possible to set a constant gain, for example G=−3 dB=$10^{-3/20}$, which eliminates the need for a correlation estimation which can be costly. The constant gain G can then be applied offline to the weighting factors (thus giving $$\left(\text{thus giving } \frac{G}{W^{g/d}(l)}\right),$$

or to the filter $B_{mean}^{g/d}$, which eliminates the application of additional gain on the fly.

Once the transfer functions A and B are isolated and the filters $B_{mean}^{g/d}$ (optionally the weights $W^{g/d}(l)$ and G) are calculated, these transfer functions and filters are applied to the input signals.

In a first embodiment, described with reference to FIG. 4, the processing of the multichannel signal by application of the Direct (A) and Diffuse (B) filters for each ear is carried out as follows:

We apply (steps S4A1 to S4AL) to the multichannel input signal an efficient filtering (for example direct FFT-based convolution) by Direct (A) filters, as described in the prior art. We thus obtain a signal $\hat{O}_A^{g/d}$.

On the basis of the relations between the input signals, particularly their correlation, we can optionally correct in step S4B11 the gain of the mean filter $B_{mean}^{g/d}$ by applying the gain G to the output signals after summation of the previously weighted input signals (steps M4B1 to M4BL).

We apply, in step S4B1, to the multichannel signal B an efficient filtering using the Diffuse mean filter $B_{mean}$. This step occurs after summation of the previously weighted input signals (steps M4B1 to M4BL). We thus obtain the signal $\hat{O}_B^{g/d}$.

We apply a delay iDD to signal $\hat{O}_B^{g/d}$ in order to compensate for the delay introduced during the step of isolating signal B in step S4B2.

Signals $\hat{O}_B^{g/d}$ and $\hat{O}_B^{g/d}$ are summed.

If a truncation removing the inaudible samples at the beginning of the impulse responses has been performed, we then apply to the input signal, in step S41, a delay iT corresponding to the inaudible samples removed.

Alternatively, with reference to FIG. 5, the signals are not only calculated for the left and right ears (indices g and d above), but also for k rendering devices (typically speakers).

In a second embodiment, the gain G is applied prior to summation of the input signals, meaning during the weighting steps (steps M4B1 to M4BL).

In a third embodiment, a decorrelation is applied to the input signals. Thus, the signals are decorrelated after convolution by the filter $B_{mean}$ regardless of the original correlations between input signals. An efficient implementation of the decorrelation can be used (for example, using a feedback delay network) to avoid the use of expensive decorrelation filters.

Thus, under the realistic assumption that BRIR 48000 samples in length can be:

truncated between sample 150 and sample 3222 by the technique described in step S21, broken into two parts: direct field A of 1024 samples, and diffuse field B of 2048 samples, by the technique described in step S22, then the complexity of the binauralization can be approximated by:

$$C_{inv}=C_{invA}+C_{invB}=(L+2)\cdot(6\cdot\log_2(2\cdot NA))+(L+2)\cdot(6\cdot\log_2(2\cdot NB))$$

where NA and NB are the sample sizes of A and B.

Thus, for nBlocks=10, Fs=48000, L=22, NA=1024, and NB=2048, the complexity per multichannel signal sample for an FFT-based convolution is $C_{conv}$=3312 multiplications-additions.

However, logically this result should be compared to a simple solution that implements truncation only, meaning for nBlocks=10, Fs=3072, L=22:

$$C_{trunc}=(L+2)\cdot(n\text{Blocks})\cdot(6\cdot\log_2(2\cdot Fs/n\text{Blocks}))=13339$$

There is therefore a complexity factor of 19049/3312=5.75 between the prior art and the invention, and a complexity factor of 13339/3312=4 between the prior art using truncation and the invention.

If the size of B is a multiple of the size of A, then if the filter is implemented by FFT blocks, the calculation of an FFT for A can be reused for B. We therefore need L FFT over NA points, which will be used both for the filtration by A and by B, two inverse FFT over NA points to obtain the temporal binaural signal, and multiplication of the frequency spectra.

In this case, the complexity can be approximated (leaving out additions, (L+1) corresponding to multiplication of the spectra, L for A and 1 for B) by:

$$C_{inv2}=(L+2)\cdot(6\cdot\log_2(2\cdot NA))+(L+1)=1607$$

With this approach, we gain a factor of 2, and therefore a factor of 12 and 8 in comparison to the truncated and non-truncated prior art.

The invention can have direct applications in the MPEG-H 3D Audio standard.

Of course, the invention is not limited to the embodiment described above; it extends to other variants.

For example, an embodiment has been described above in which the Direct signal A is not approximated by a mean filter. Of course, one can use a mean filter of A to perform the convolutions (steps S4A1 to S4AL) with the signals coming from the speakers.

An embodiment based on the processing of multichannel content generated for L speakers was described above. Of course, the multichannel content may be generated by any type of audio source, for example voice, a musical instrument, any noise, etc.

An embodiment based on formulas applied in a certain computational domain (for example the transform domain) was described above. Of course, the invention is not limited to these formulas, and these formulas can be modified to be applicable in other computational domains (for example time domain, frequency domain, time-frequency domain, etc.).

An embodiment was described above based on BRIR values determined in a room. Of course, one can implement the invention for any type of outside environment (for example a concert hall, al fresco, etc.).

An embodiment was described above based on the application of two transfer functions. Of course, one can implement the invention with more than two transfer functions. For example, one can synchronistically isolate a portion relative to the directly emitted sounds, a portion relative to the first reflections, and a portion relative to the diffuse sounds.

The invention claimed is:

1. A method of sound spatialization, wherein at least one block-based filtering process, with summation, is applied to at least two input signals, said filtering process comprising:

applying at least one first room effect transfer function, said first transfer function being constructed from at least one first part and being specific to each input signal, and applying at least one second room effect transfer function, said second transfer function being constructed from at least one second part and being common to all input signals, wherein the method comprises: weighting at least one input signal with a weighting factor, said weighting factor being specific to each of the input signals;

wherein at least one output signal of said method is given by applying a formula of the type:

$$O^k=\sum_{l=1}^{L}(I(l)*A^k(l))+z^{-iDD}\cdot\sum_{l=1}^{L}\left(\frac{1}{W^k(l)}\cdot I(l)\right)*B^k_{mean}$$

where k is the index of an output signal, $O^k$ is an output signal, l∈[1; L] is the index of an input signal among said input signals, L is the number of input signals, I(l) is an input signal among said input signals, $A^k(l)$ is a room effect transfer function among said first room effect transfer functions, $B_{mean}{}^k$ is a room effect transfer function among said second room effect transfer functions, $W^k(l)$ is a weighting factor among said weighting factors, $z^{-iDD}$ corresponds to the application of said compensating delay, with · indicating multiplication, and

* being the convolution operator.

2. The method according to claim 1, wherein said first and second transfer functions are respectively representative of:

direct sound propagations and the first sound reflections of said propagations; and a diffuse sound field present after said first reflections, and wherein the method comprises:

the application of first transfer functions respectively specific to the input signals, and the application of a second transfer function, identical for all input signals, and resulting from a general approximation of a diffuse sound field effect.

3. The method according to claim 2, comprising a preliminary step of constructing said first and second transfer functions from impulse responses incorporating a room effect, said preliminary step comprising, for the construction of a first transfer function, the operations of:

determining a start time of the presence of direct sound waves, determining a start time of the presence of said diffuse sound field after the first reflections, and selecting, in an impulse response, a portion of the response which extends temporally between said start time of the presence of direct sound waves to said start time of the presence of the diffuse field, said selected portion of the response corresponding to said first transfer function.

4. The method according to claim 3, wherein the second transfer function is constructed from a set of portions of impulse responses temporally starting after said start time of the presence of the diffuse field.

5. The method according to claim 3, wherein said second transfer function is given by applying a formula of the type:

$$B_{mean}^{k} = \frac{1}{L}\sum_{l=1}^{L}[B_{norm}^{k}(l)]$$

where k is the index of an output signal, l∈[1; L] is the index of an input signal, L is the number of input signals, $B_{norm}{}^{k}(l)$ is a normalized transfer function obtained from a set of portions of impulse responses starting temporally after said start time of the presence of the diffuse field.

6. The method according to claim 3, wherein said filtering process includes the application of at least one compensating delay corresponding to a time difference between said start time of the direct sound waves and said start time of the presence of the diffuse field.

7. The method according to claim 6, wherein said first and second room effect transfer functions are applied in parallel to said input signals and wherein said at least one compensating delay is applied to the input signals filtered by said second transfer functions.

8. The method according to claim 1, wherein an energy correction gain factor is applied to the weighting factor.

9. The method according to claim 1, wherein it comprises a step of decorrelating the input signals prior to applying the second transfer functions, and wherein at least one output signal of said method is obtained by applying a formula of the type:

$$O^{k} = \sum_{l=1}^{L}(I(l) * A^{k}(l)) + z^{-iDD}\cdot\sum_{l=1}^{L}\left(\frac{1}{W^{k}(l)}\cdot I_{d}(l)\right) * B_{mean}^{k}$$

where k is the index of an output signal, $O^{k}$ is an output signal, l∈[1; L] is the index of an input signal among said input signals, L is the number of input signals, I(l) is an input signal among said input signals, $I_{d}(l)$ is a decorrelated input signal among said input signals, $A^{k}(l)$ is a room effect transfer function among said first room effect transfer functions, $B_{mean}{}^{k}$ is a room effect transfer function among said second room effect transfer functions, $W^{k}(l)$ is a weighting factor among said weighting factors, $z^{iDD}$ corresponds to the application of said compensating delay, with · indicating multiplication, and

* being the convolution operator.

10. The method according to claim 1, wherein it comprises a step of determining an energy correction gain factor as a function of input signals and wherein at least one output signal is obtained by applying a formula of the type:

$$O^{k} = \sum_{l=1}^{L}(I(l) * A^{k}(l)) + z^{-iDD}\cdot\sum_{l=1}^{L}\left(G(I(l))\cdot\frac{1}{W^{k}(l)}\cdot I(l)\right) * B_{mean}^{k}$$

where k is the index of an output signal, $O^{k}$ is an output signal, l∈[1; L] is the index of an input signal among said input signals, L is the number of input signals, I(l) is an input signal among said input signals, G(I(l)) is said determined energy correction gain factor, $A^{k}(l)$ is a room effect transfer function among said first room effect transfer functions, $B_{mean}{}^{k}$ is a room effect transfer function among said second room effect transfer functions, $W^{k}(l)$ is a weighting factor among said weighting factors, $z^{iDD}$ corresponds to the application of said compensating delay, with · indicating multiplication, and

* being the convolution operator.

11. The method according to claim 1, wherein said weight is given by applying a formula of the type:

$$W^{k}(l) = \frac{\sqrt{E_{B_{mean}^{k}}}}{\sqrt{E_{B^{k}(l)}}}$$

where k is the index of an output signal, l∈[1; L] is the index of an input signal among said input signals, L is the number of input signals, where $E_{B_{mean}{}^{k}}$ is the energy of a room effect transfer function among said second room effect transfer functions, $E_{B^{k}(l)}$ is energy relating to normalization gain.

12. A non-transitory computer-readable storage medium with an executable program stored thereon, wherein the program instructs a microprocessor to perform steps of the method according to claim 1.

13. A sound spatialization device, comprising at least one filter with summation applied to at least two input signals, said filter using:

at least one first room effect transfer function, said first transfer function being constructed from at least one first part and being specific to each input signal, and at least one second room effect transfer function, said second transfer function being constructed from at least one second part and being common to all input signals, wherein it comprises weighting modules for weighting at least one input signal with a weighting factor, said weighting factor being specific to each of the input signals;

wherein at least one output signal of said method is given by applying a formula of the type:

$$O^{k} = \sum_{l=1}^{L}(I(l) * A^{k}(l)) + z^{-iDD}\cdot\sum_{l=1}^{L}\left(\frac{1}{W^{k}(l)}\cdot I_{d}(l)\right) * B_{mean}^{k}$$

where k is the index of an output signal, $O^{k}$ is an output signal, l∈[1; L] is the index of an input signal among said input signals, L is the number of input signals, I(l) is an input signal among said input signals, $A^k(l)$ is a room effect transfer function among said first room effect transfer functions, $B_{mean}{}^k$ is a room effect transfer function among said second room effect transfer functions, $W^k(l)$ is a weighting factor among said weighting factors, $z^{-iDD}$ corresponds to the application of said compensating delay, with · indicating multiplication, and

* being the convolution operator.

14. An audio signal decoding module, comprising the spatialization device according to claim 13, said sound signals being input signals.

* * * * *